US007128435B1

(12) United States Patent
Conathan et al.

(10) Patent No.: US 7,128,435 B1
(45) Date of Patent: Oct. 31, 2006

(54) LUMINAIRE

(75) Inventors: Edward N. Conathan, Saugerties, NY (US); Paul Joshua Shapiro, Poughkeepsie, NY (US)

(73) Assignee: LSI Industries, Inc., Cincinnati, OH (US)

( * ) Notice: Subject to any disclaimer, the term of this patent is extended or adjusted under 35 U.S.C. 154(b) by 58 days.

(21) Appl. No.: 11/105,018

(22) Filed: Apr. 13, 2005

(51) Int. Cl.
*F21S 8/02* (2006.01)

(52) U.S. Cl. ..... 362/147; 362/339; 362/326; 362/332

(58) Field of Classification Search ..... 362/147, 362/148, 150, 339, 327, 328, 326, 330, 332
See application file for complete search history.

(56) References Cited

U.S. PATENT DOCUMENTS 4,475,147 A * 10/1984 Kristofek ..... 362/148
6,561,670 B1 * 5/2003 Jongewaard et al. ..... 362/147
6,632,006 B1 * 10/2003 Rippel et al. ..... 362/366
6,698,909 B1 * 3/2004 Jones ..... 362/339
6,811,287 B1 * 11/2004 Roller et al. ..... 362/336

OTHER PUBLICATIONS

Zumtobel Staff, The Light®, Lensed Recessed Wallwasher 7, Diagonal Compact Fluorescent (2) 26w Quad Tube, S5-13 (1 page).
LIGHTOLIER®, Calculite® Compact Fluorescent Lensed Wall Washer 8046, 6 Aperture Triple Tube Wall Washer, pp. 1-2.

* cited by examiner

*Primary Examiner*—Laura K. Tso
(74) *Attorney, Agent, or Firm*—Daniel F. Nesbitt; Hasse & Nesbitt LLC

(57) ABSTRACT

A ceiling-mounted luminaire having a bent lens that has a horizontal portion for directing light downward, and a bent or diagonal portion for directing diagonally light toward an adjacent wall. The luminaire improves the flooding of light onto the wall. An auxiliary reflector plate can be inserted within the main reflector to direct more of the source light toward the diagonal portion of the lens to improve the wall lighting.

8 Claims, 2 Drawing Sheets

LUMINAIRE

BACKGROUND OF THE INVENTION

The present invention relates to a ceiling-mounted luminaire.

Providing lighting onto a vertical wall is often done with a flood or reflector lamp that is positioned a distance from the wall and is directed at the wall to flood the wall with light. Typically such wall-flooding lights are ceiling mounted or suspended. One type of ceiling-mounted light uses a lens to improve the photometrics of the light source, typically by orienting a planar lens at an angle that projects the light diagonally toward the wall onto which the luminaire is attached. Wall-mounted lighting has also been used to provide lighting onto the wall surface, as well as to provide the surrounding floor area with light. Nevertheless, there remains a need to improve the lighting onto a sidewall, as well as to the surrounding floor area.

SUMMARY OF THE INVENTION

The present invention relates to a ceiling-mounted luminaire for directing light at the wall, comprising: a) a support structure configured for mounting into a ceiling adjacent to the wall; b) a reflector secured to the support structure, having a reflective inner surface and an open end extending toward an opening in the ceiling; c) a powered light source disposed within the interior of the reflector; and d) a lens positioned proximate the open end of the reflector for refracting the light passing out of the open end of the reflector; wherein the lens comprises a horizontal portion for refracting a portion of the light perpendicularly downward from the ceiling, and a diagonal portion for refracting a portion of the light diagonally toward the wall.

The present invention also relates to a bent lens for use in a luminaire, comprising: a first planar semi-circular portion having a surface comprising a pattern of prisms, and a second planar semi-elliptical portion having a surface comprising a pattern of prisms, the semi-elliptical portion being oriented at an angle from the first planar portion, wherein a source of light passing through the lens is directed in a first direction perpendicular to the first planar portion, and in a second direction perpendicular to the second planar portion and diagonally downward from the first direction.

DETAILED DESCRIPTION OF THE INVENTION

The present invention provides an improved ceiling-mounted luminaire for providing light to an adjacently-disposed wall and to the surrounding floor space.

Figure 1:
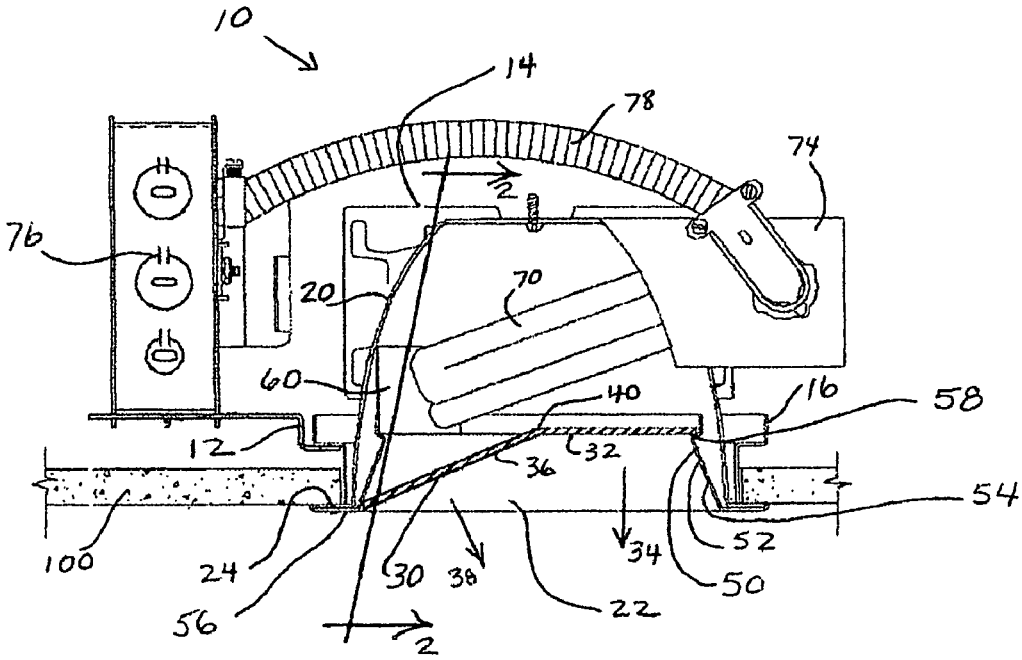
FIG. 1 shows a side elevation view of a luminaire of the present invention with a partial cross sectional view of a reflector with a bent lens.
Figure 2:
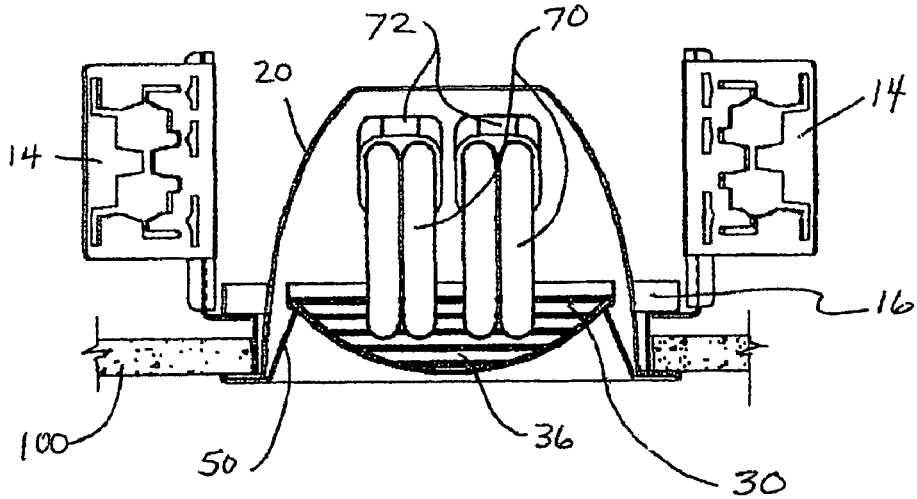
FIG. 2 shows a partial front elevation view of the luminaire of FIG. 1 viewed from line 2—2.

FIGS. 1 and 2 show a luminaire 10 comprising a support structure 12 for conventional mounting of the luminaire into a ceiling 100 adjacent to the wall. The support structure 12 comprises a pair of hanger brackets 14 and a pan 16 for supporting other elements of the luminaire. A dome-shaped reflector 20 is secured to the support structure 12. The reflector is illustrated with an open end 22 at its lower end having a diameter comparable to the height of the reflector. The reflector 20 has a reflective inner surface that is shaped to reflect light emitted from a light source toward the open end 22. The open end 22 extends toward an opening in the ceiling. In the illustrated embodiment, the reflector is configured with an outwardly-extending flange 24 that can be affixed and secured to the lower end of the pan 16.

Figure 3:
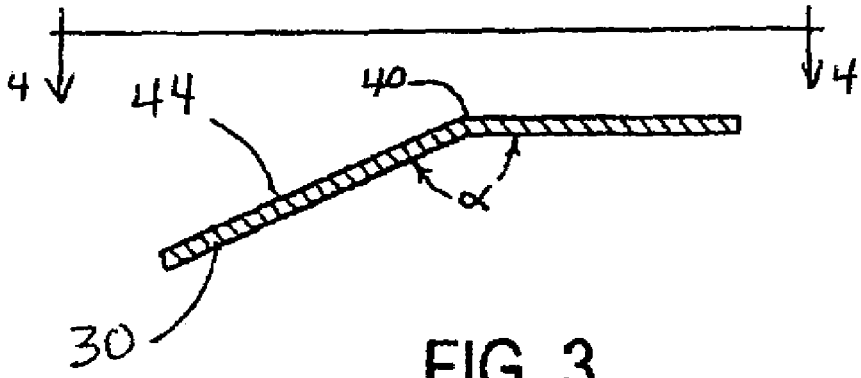
FIG. 3 shows a cross-sectional side view of the bent lens of the present invention.
Figure 4:
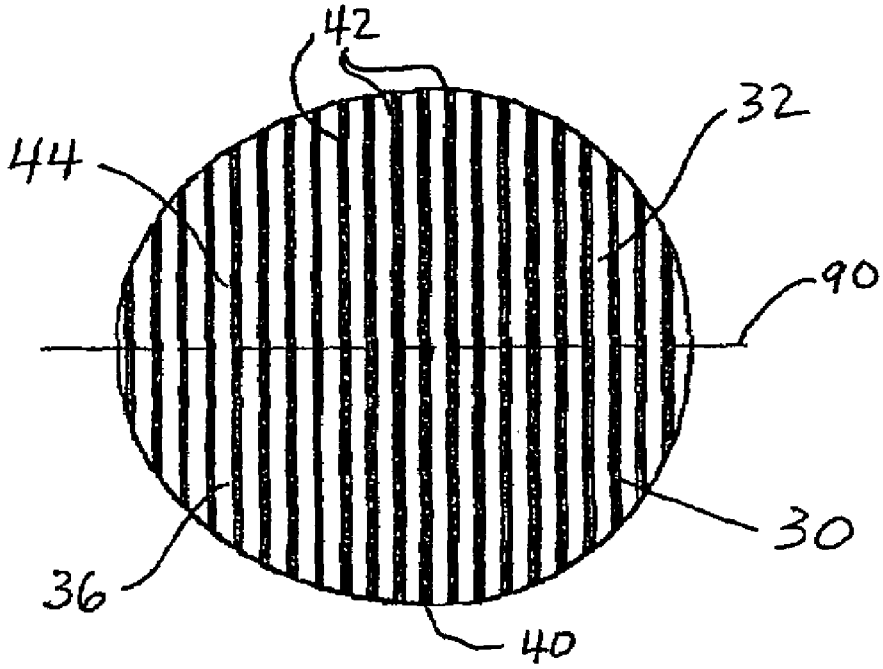
FIG. 4 shows a top plan view of the bent lens of FIG. 3 viewed from line 4—4.

The luminaire 10 is provided with a lens 30 for directing a source of light within the reflector through the open end 22 in at least two predetermined directions. The lens 30 is positioned proximate the open end 22 of the reflector 20 for refracting the light passing out of the open end of the reflector and into the at least two directions. As shown in FIGS. 3 and 4, the lens 30 comprises a horizontal portion 32 for perpendicularly refracting a portion of the light in a vertically downward direction 34 from the ceiling 100, and a diagonal portion 36 for perpendicularly refracting a portion of the light in a diagonal direction 38 downward and toward the wall. The horizontal portion 32 of the lens has a semi-circular shape. The diagonal portion 36 of the lens has a semi-elliptical shape and is oriented at an angle and projects downward from the horizontal planar portion 32. The semi-circular and semi-elliptical portions are joined along a linear joint 40 into a unitary bent lens.

Typically, the lens has a bending angle $\alpha$ of between about 15 degrees to 25 degrees. In the illustrated embodiment, the bending angle is about 20 degrees. The bending angle is selected to provide the desired photometrics based in part on ceiling height and placement distance from the wall.

Preferably the lens comprises a pattern of prisms 42 on a surface thereof for preferential directing of the light source toward a desired direction. In the illustrated embodiment, the pattern of prisms are shown as a series of spaced-apart linear prisms that run parallel to the linear joint 40 on both the horizontal and diagonal portions of the lens, and are disposed laterally on the upper or reflector-side surface 44 of the lens, from one end of the lens to the other end along a bisecting centerline 90. Alternative patterns for the plurality of prisms can also be used to enhance the projection of light evenly and broadly onto the wall, such as curvilinear and combinations of linear and curvilinear patterns.

In the illustrated embodiment, the lens is affixed within a circular splay 50 having a tapered sidewall 52. The splay sidewall 52 has a lower open end 54 that registers with the open end 22 of the reflector, and that has an outward-extending flange 56 for affixment to the flange 24 of the reflector. The sidewall 52 also has an open upper end 58 through which light from the light source 70 passes. In the illustrated embodiment, the semi-circular periphery of the horizontal portion 32 of the lens is secured to the upper end 58 of the sidewall 52, and the semi-elliptical periphery of the diagonal portion 36 of the lens extends and is secured along the tapered sidewall 52 toward the lower end 54. Typically, the splay 50 with the affixed lens 30 is configured for rotational attachment to the reflector 20 for arbitrary and precise positioning of the lens and the emitted diagonal lighting against the wall.

In a preferred embodiment shown in FIG. 1, the luminaire also comprises an auxiliary reflector 60 positioned within the reflector proximate to and above the diagonal portion 36 of the lens. The auxiliary reflector has an inwardly-directed concave inner surface made of a highly-reflective material that serves to focus and bounce light toward the diagonal portion 36 of the lens.

The source of light is provided by one or more electrically-powered lamps 70 that penetrate through an opening in the upper portion of the reflector 20, and are disposed within the interior of the reflector. The lamps 70 are affixed to lamp sockets 72 of a socket housing 74. Electrical power is provided to the socket housing from an electrical junction 76 box via an electrical conduit 78. In the illustrated embodiment, the reflector 20 is configured to house a pair of fluorescent tube lamps 70, mounted side-by-side. In a preferred embodiment shown in the Figures, the distal ends or tips of the lamps 70 are oriented on a downward angle and closely proximate the surface of the diagonal portion 36 of the bent lens 30. Since the tip of the lamp emits the most light, positioning the lamp tip on an angle, just behind the diagonal portion of the lens, maximizes the photometric benefit of the luminaire.

When installed into a ceiling proximate a wall, the luminaire is positioned wherein the diagonal portion 36 is positioned away from the wall, and extends downward from the horizontal portion 32 and away from the wall.

The luminaire of the present invention improves the intensity and distribution of emitted "wall washing" light onto the adjacent wall, while also providing "down light" to the surrounding floor area. The wall washing light is distributed more evenly on the wall surface, relative to conventional wall lighting luminaries. Typically, the proportional of down light to wall washing light is equal. The diagonal portion of the lens can be bent to a steeper angle than can an angled planar lens, which can provide for more light onto the wall.

We claim:

1. A ceiling-mounted luminaire for directing light at the wall, comprising:

a) a support structure configured for mounting into a ceiling adjacent to the wall;

b) a reflector secured to the support structure, having a reflective inner surface and an open end extending toward an opening in the ceiling;

c) a powered light source disposed within the interior of the reflector; and d) a lens positioned proximate the open end of the reflector for refracting the light passing out of the open end of the reflector; wherein the lens comprises a horizontal portion for refracting a portion of the light perpendicularly downward from the ceiling, and a diagonal portion for refracting a portion of the light diagonally toward the wall.

2. The ceiling-mounted luminaire according to claim 1, wherein the lens comprises:

a) a first planar semicircular portion comprising a pattern of prisms, and b) a second planar semi-elliptical portion comprising a pattern of prisms, oriented at an angle from the first planar portion;

wherein a source of light passing through the lens is directed in a first direction perpendicular to the first planar portion, and in a second direction perpendicular to the second planar portion and diagonally downward from the first direction.

3. The ceiling-mounted luminaire according to claim 1, further comprising an auxiliary reflector positioned within the reflector proximate the diagonal portion of the lens, the auxiliary reflector having an inwardly-directed concave inner surface.

4. The ceiling-mounted luminaire according to claim 2, further comprising a circular splay comprising a tapered wall having an upper end having an opening that registers with the open end of the reflector, and a second end having an opening that is configured to receive the semicircular portion of the lens, wherein the periphery of the semi-elliptical portion of the lens extends along the tapered wall toward the first end.

5. The ceiling-mounted luminaire according to claim 1, wherein the powered light source comprises an electrically-powered light bulb, configured to extend parallel and proximate to the diagonal portion of the lens.

6. The ceiling-mounted luminaire according to claim 1, wherein the first semi-circular portion is oriented within the reflector toward the wall, and the second semi-elliptical portion extends downward from the first portion and away from the wall.

7. The ceiling-mounted luminaire according to claim 2, wherein the angle is from about 15 degrees to about 25 degrees.

8. A bent lens for use in a luminaire, comprising a first planar semi-circular portion having a surface comprising a pattern of prisms, and a second planar semi-elliptical portion having a surface comprising a pattern of prisms, the semi-elliptical portion being oriented at an angle from the first planar portion, wherein a source of light passing through the lens is directed in a first direction perpendicular to the first planar portion, and in a second direction perpendicular to the second planar portion and diagonally downward from the first direction.

* * * * *